US010486783B2

(12) United States Patent
DeBilt

(10) Patent No.: US 10,486,783 B2
(45) Date of Patent: Nov. 26, 2019

(54) TROLLING MOTOR DIRECTION GUIDE AND METHOD

(71) Applicant: Bruce DeBilt, Berthold, ND (US)

(72) Inventor: Bruce DeBilt, Berthold, ND (US)

( * ) Notice: Subject to any disclaimer, the term of this patent is extended or adjusted under 35 U.S.C. 154(b) by 0 days.

(21) Appl. No.: 15/965,016

(22) Filed: Apr. 27, 2018

(65) Prior Publication Data

US 2019/0329847 A1 Oct. 31, 2019

(51) Int. Cl.

| | |
|---|---|
| ***B63B 49/00*** | (2006.01) |
| ***B63H 25/02*** | (2006.01) |
| ***B63H 20/00*** | (2006.01) |

(52) U.S. Cl.

CPC ..... *B63B 49/00* (2013.01); *B63H 20/007* (2013.01); *B63H 25/02* (2013.01); *B63H 2025/028* (2013.01)

(58) Field of Classification Search

CPC ..... B63B 49/00; B63H 20/007; B63H 25/02; B63H 2025/028

See application file for complete search history.

(56) References Cited

U.S. PATENT DOCUMENTS

| | | | | |
|---|---|---|---|---|
| 2,995,650 | A * | 8/1961 | Kiekhaefer | B63B 45/04 362/395 |
| 4,884,173 | A * | 11/1989 | Cassidy | B60Q 1/24 362/477 |
| 5,029,551 | A * | 7/1991 | Rosen | B63C 9/20 116/209 |
| 5,919,067 | A * | 7/1999 | Smith | B63B 17/00 114/343 |
| 2003/0194921 | A1* | 10/2003 | Leiss | B63H 20/007 440/6 |
| 2016/0244129 | A1* | 8/2016 | Cromartie | B63B 21/26 |

* cited by examiner

*Primary Examiner* — Stephen P Avila
(74) *Attorney, Agent, or Firm* — Robert C. Freed; Dykema Gossett PLLC

(57) ABSTRACT

A visual direction guide for a fishing boat trolling motor to enable a fisherman or other operator positioned remotely in the boat from the trolling motor to visually determine the direction of propulsion of the trolling motor so the operator can steer the motor even when the view from the operator of the trolling motor is visually obstructed by another fisherman, chair, or other object. The visual direction guide has a support shaft, a visual indicator located at the top of the support shaft, and mounting apparatus to secure the support shaft to the trolling motor, so that the visual indicator can be seen by the operator above any visual obstruction to determine the direction of propulsion of the trolling motor to remotely steer the trolling motor. The visual indicator can include a vane, and can include lights. The support shaft can telescope, fold down, or be removed for storage.

24 Claims, 10 Drawing Sheets

TROLLING MOTOR DIRECTION GUIDE AND METHOD

CROSS-REFERENCE TO RELATED APPLICATIONS

None

FIELD OF THE INVENTION

The present invention relates to an orientation indicator for a boat motor, and more specifically, to a visual indicator that provides a visual indication of the propulsion direction of a trolling motor secured to the front of a fishing boat. The invention also relates to methods for making and using such orientation indicator.

BACKGROUND OF THE DISCLOSURE

In a small fishing boat used for trolling, there is typically a principal motor for general propulsion of the boat, often mounted at the stern or rear portion of the boat, and a smaller motor for propulsion of the boat during trolling. The trolling motor is typically mounted at or near the bow or front portion of the boat. A fisherman or other person operating the principal motor normally sits near the rear of the boat to control the operation of the principal motor. The trolling motor typically is controllable by a remote controller such as a foot switch, which can be located so that an operator sitting near the rear of the boat can also control the trolling motor so as to move the boat in a desired direction while trolling. In typical arrangements, however, the view of the trolling motor by an operator sitting near the rear of the boat is often obstructed by a fisherman near the front of the boat, either standing or sitting near the bow. Even if there is no person near the front of the boat, a chair or seat, or other structure, can obstruct the view of the trolling motor so that an operator cannot easily determine which direction the propulsion of the trolling motor is oriented. It will be appreciated that there is need for an improved way for a remote operator to determine the orientation of the direction of propulsion of such trolling motor. The present invention provides improvements that address limitations associated with the prior art efforts to address this difficulty.

SUMMARY OF THE INVENTION

The present invention includes a visual direction guide for a fishing boat trolling motor to enable a fisherman or other operator positioned in the boat remotely from the trolling motor to visually determine the direction of propulsion of the trolling motor so the operator can steer the motor even when the view from the operator of the trolling motor is visually obstructed by another fisherman, chair, or other object. The visual direction guide preferably includes an elongated indicator support shaft, a visual indicator located at the top portion of the support shaft, and mounting apparatus to secure the support shaft to the trolling motor, so that the visual indicator can be seen by the operator to determine the direction of propulsion of the trolling motor above the visual obstruction. In some embodiments, the visual indicator includes a vane, which may be shaped in various ways, but indicates a direction. In some embodiments, the visual indicator includes one or more lights, so that the orientation of the visual indicator, and therefore the direction of propulsion of the trolling motor, can be determined in low visibility or poor lighting conditions. In some embodiments, the visual indicator includes a vane and two lights, a white light towards the front of the vane indicating the front or direction of propulsion, and a red light towards the rear of the vane indicating the rear. In various embodiments, the elongated support shaft can be telescoping, non-telescoping, bent, or be longer or shorter. In various embodiments, the mounting apparatus includes a bracket, a fastener, a folding bracket, one or more clamps, a clip which attaches to a trolling motor head, or a trolling motor head socket. In various embodiments, the visual direction guide can be telescopingly collapsed, folded down, or removed for storage. In some embodiments, the invention includes a trolling motor and a visual direction guide. In various embodiments, the visual indicator is located a distance above the trolling motor so that the visual indicator can be seen by the operator above any visual obstructions which may be present, in order to determine the orientation of the trolling motor to facilitate steering of the trolling motor. In some embodiments, the invention includes a method of determining the direction of propulsion of a trolling motor, including providing a visual direction guide with a support shaft, a visual indicator, and a mounting apparatus, securing the visual indicator to the support shaft and securing the support shaft to the trolling motor with the mounting apparatus, so that the visual indicator is oriented with respect to the trolling motor to indicate the direction of propulsion of the trolling motor by viewing the visual indicator. In preferred embodiments, the invention includes the step of locating the visual indicator from about 36 inches to about 72 inches above the trolling motor head so the visual indicator can be seen above a visual obstruction. In more preferred embodiments, the invention includes the step of locating the visual indicator from about 36 inches to about 48 inches above the trolling motor head.

In a preferred embodiment of the present invention, a visual direction guide is preferably provided that is useable with a steerable trolling motor apparatus, mountable on a fishing boat, to enable an operator positioned remotely in the boat from the trolling motor to visually determine the direction of propulsion of the trolling motor when the operator's view of the trolling motor is visually obstructed, wherein the visual direction guide includes an elongated indicator support shaft; a visual indicator securable to an upper portion of the elongated indicator support shaft; and a support shaft mounting apparatus securable to a lower portion of the elongated indicator support shaft and securable to a portion of the trolling motor apparatus; wherein when the visual indicator is secured to the indicator support shaft and the shaft mounting apparatus is secured to the indicator support shaft and to the trolling motor apparatus, the visual indicator is oriented with respect to the trolling motor apparatus so that the operator can determine the direction of propulsion of the trolling motor apparatus by viewing the orientation of the visual indicator, even when the trolling motor apparatus is not visible to the operator.

In preferred embodiments the visual indicator will include a vane, preferably selected from the group consisting of a triangular-shaped vane, a boat-shaped vane, a fish-shaped vane, and an arrow-shaped vane. In further preferred embodiments the visual indicator will include a light, preferably two lights, each light being distinguishable from the other light and being oriented so that the orientation of the visual indicator can be determined by the operator when there is little ambient light. In preferred embodiments the elongated support shaft is a telescoping shaft, wherein when the visual direction guide is in use, the visual indicator is preferably located above the trolling motor. In further preferred embodiments the visual direction guide will include a folding bracket which allows the indicator support shaft to be folded down for storage.

In a further embodiment of the present invention a steerable trolling motor apparatus is provided. The steerable trolling motor apparatus will preferably be mountable on the bow of a fishing boat to enable an operator positioned remotely in the fishing boat from the bow to visually determine a direction of propulsion so as to effectively steer when the operator's view is visually obstructed. The steerable trolling motor apparatus preferably includes a trolling motor attachable to the bow of the fishing boat, the trolling motor having a trolling motor head and a trolling motor shaft; a remote controller capable of turning the trolling motor with respect to the trolling motor shaft; and a visual direction guide including an elongated indicator support shaft, a visual indicator securable to an upper portion of the elongated indicator support shaft, and a shaft mounting apparatus securable to a lower portion of the elongated indicator support shaft and securable to a portion of the trolling motor apparatus; wherein when the visual indicator is secured to the indicator support shaft and the shaft mounting apparatus is secured to the indicator support shaft and to the trolling motor, the visual indicator is oriented with respect to the trolling motor so that the operator can determine the direction of propulsion of the trolling motor by viewing the orientation of the visual indicator, even when the trolling motor is not visible to the operator.

In a further embodiment of the present invention a method of determining a direction of propulsion of a trolling motor attached to a bow of a boat is provided; the method preferably including the steps of: providing a visual direction guide, the visual direction guide including an elongated indicator support shaft, a visual indicator securable to an upper portion of the elongated indicator support shaft, and a shaft mounting apparatus securable to a lower portion of the elongated indicator support shaft and securable to a portion of the trolling motor; securing the visual indicator to the indicator support shaft and securing the shaft mounting apparatus to the indicator support shaft and to the trolling motor so that the visual indicator is oriented with respect to the trolling motor apparatus so as to visually indicate the orientation of the direction of propulsion of the trolling motor; wherein the trolling motor is steerable to vary the direction of propulsion of the trolling motor and includes a trolling motor head, and further includes the step of: locating the visual indicator at least about 30 inches above the trolling motor head when the visual indicator is secured to the indicator support shaft and the shaft mounting apparatus is secured to the indicator support shaft and to the trolling motor, so that when an operator of the trolling motor steers the trolling motor to vary the direction of propulsion of the trolling motor, the visual indicator orients to indicate the direction of propulsion of the trolling motor, so that the operator of the trolling motor can visually determine the direction of propulsion of the trolling motor even when the trolling motor is not visible to the operator.

In further embodiments of the present invention a method of steering a fishing boat having a trolling motor apparatus attached to a bow of the fishing boat, the trolling motor apparatus including a remote controller is provided; the method preferably including the steps of: providing a visual direction guide, the visual direction guide including an elongated indicator support shaft, a visual indicator securable to an upper portion of the elongated indicator support shaft, and a support shaft mounting apparatus securable to a lower portion of the elongated indicator support shaft and securable to a portion of the trolling motor; securing the visual direction guide to the trolling motor apparatus; observing the orientation of the visual indicator to determine the direction of propulsion of the trolling motor apparatus; and steering the fishing boat with the remote controller.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the present invention.

BRIEF DESCRIPTION OF THE DRAWINGS

In the drawings, in which corresponding reference numerals and letters indicate corresponding parts of the various embodiments throughout the several views, and in which the various embodiments generally differ only in the manner described and/or shown, but otherwise include corresponding parts.

DETAILED DESCRIPTION

Figure 1:
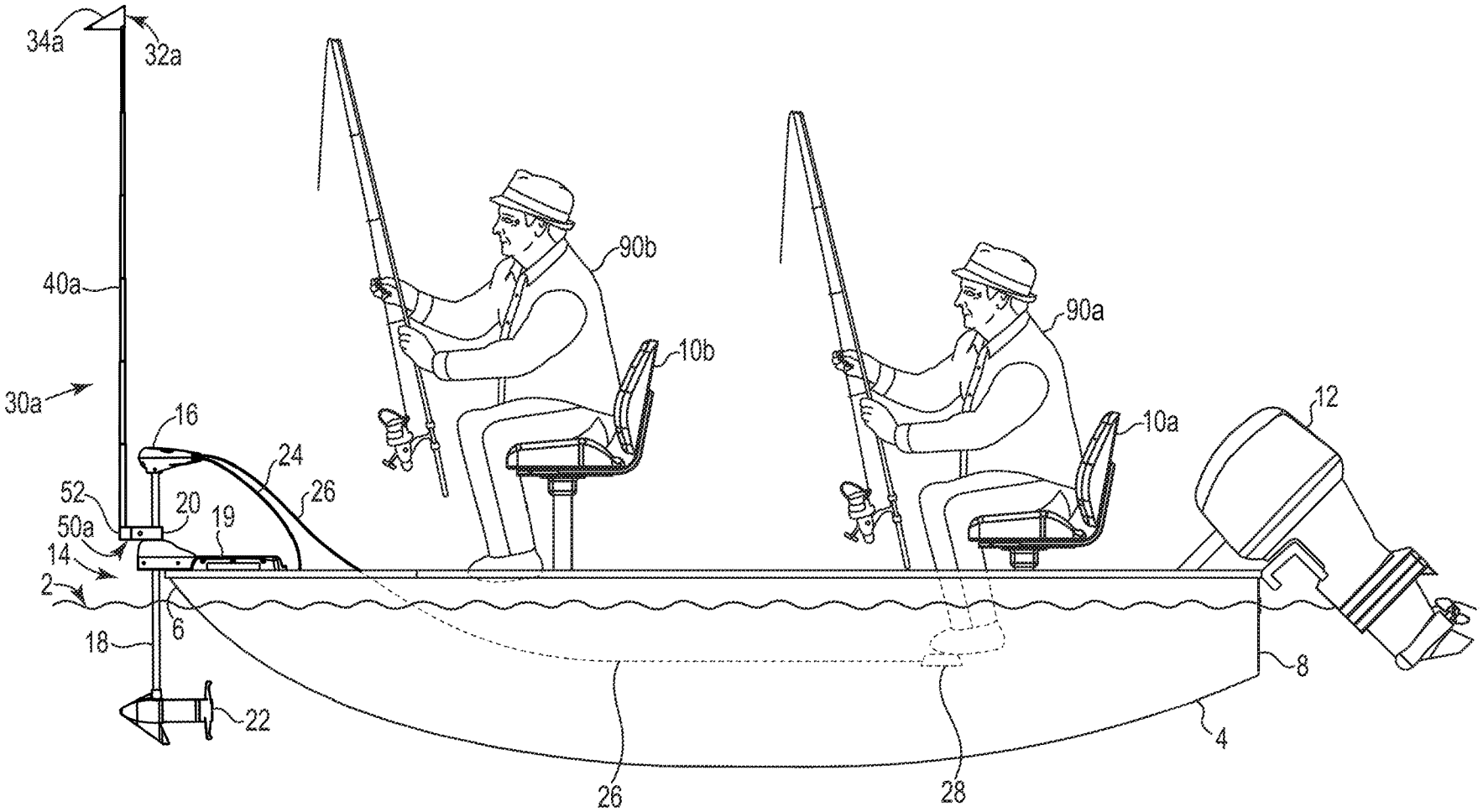
FIG. 1 is a schematic illustration of a preferred embodiment of the present trolling motor direction guide, showing the preferred direction guide in use by a fisherman operating a trolling motor while utilizing the trolling motor direction guide.
Figure 2:
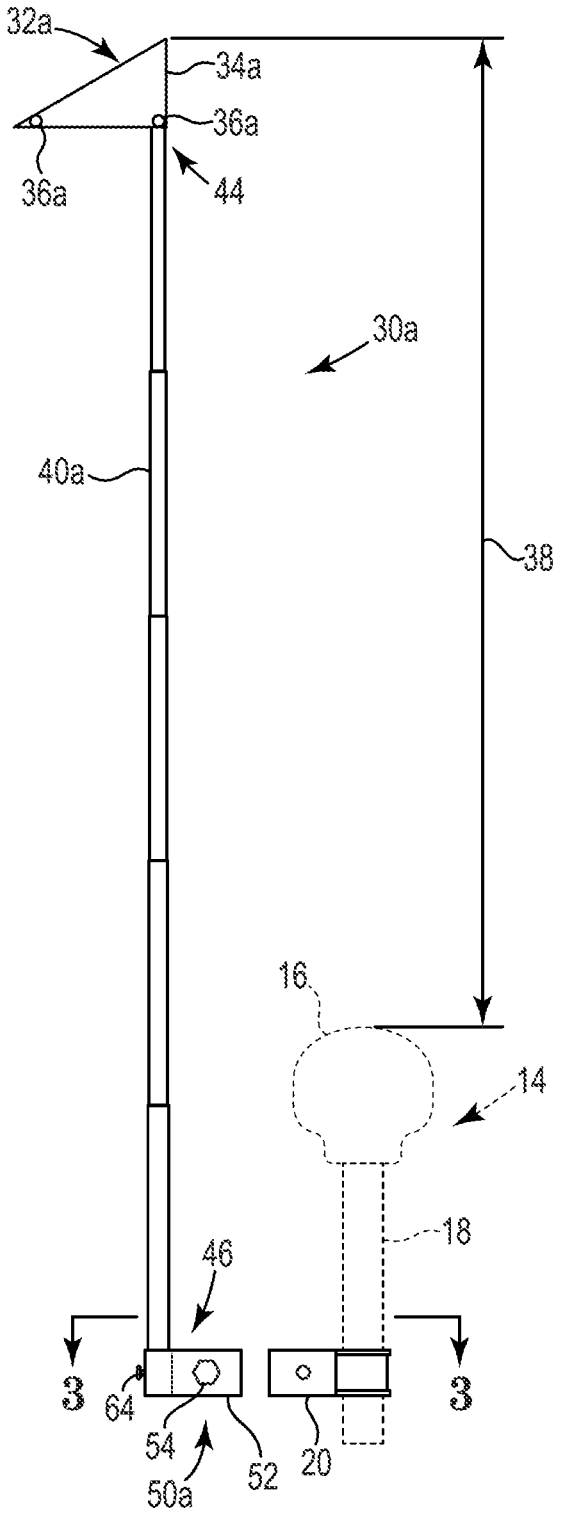
FIG. 2 further illustrates the preferred embodiment of the trolling motor direction guide 30*a* of FIG. 1, showing a visual indicator including a triangular vane and lights, and showing the trolling motor and a portion of the trolling motor shaft in phantom.
Figure 3:
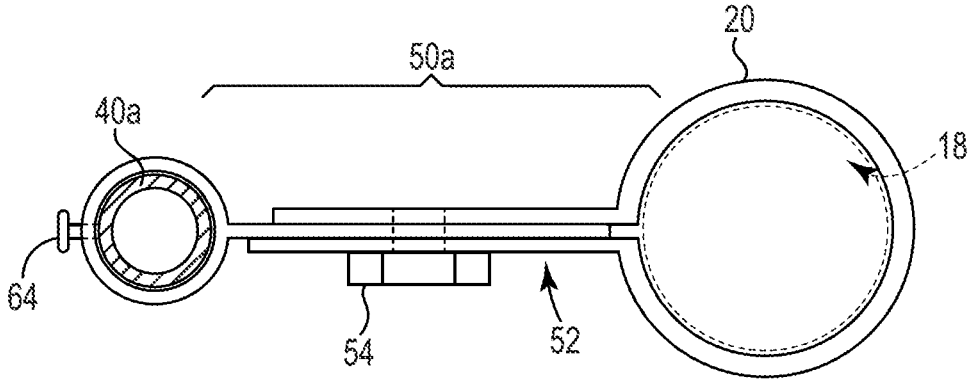
FIG. 3 further illustrates a portion of the trolling motor direction guide of FIGS. 1-2 as seen from line 3-3 on FIG. 2, which shows a shaft mounting bracket apparatus 50*a* securing the shaft 40*a* (seen in cross-section) of the trolling motor direction guide to the trolling motor shaft 18*a* (shown in phantom)

Referring now to FIGS. 1-10, and particularly to FIGS. 1-3, a trolling motor direction guide 30*a* of the present invention is illustrated. As seen in FIG. 1, a boat 4 used for trolling typically has a principal motor 12 for general propulsion of the boat 4; the principal motor 12 is typically mounted at the rear portion or stern 8 of the boat 4. A trolling motor apparatus 14 is mounted to the boat 4 by a trolling motor boat mount apparatus 19, and includes a trolling motor head 16, a trolling motor shaft 18, and a trolling motor propeller 22. The trolling motor apparatus 14 is preferably battery-powered and operates relatively quietly to slowly propel the boat 4 during trolling. For example, the trolling motor apparatus 14 can include the Minn Kota Terrova 80 Bow-Mount Trolling Motor, available from Johnson Outdoors, Inc., Racine, Wis., but many other commercially-available trolling motors can be used as well. The trolling motor apparatus 14 is preferably mounted at or near the front portion or bow 6 of the boat 4. A fisherman or operator 90*a* operating the principal motor 12 typically sits on a seat or chair 10*a* near the stern 8 of the boat 4 to control the operation of the principal motor 12. The trolling motor apparatus 14 preferably includes a foot switch or other remote control or remote controller 28 which can be located remote from the trolling motor head 16 so that an operator 90*a* sitting near the rear portion 8 of the boat 4 can also control the trolling motor apparatus 14, to move the boat 4 in a desired direction while trolling. During trolling, the principal motor 12 may be raised as illustrated in FIG. 1 if desired, such as for trolling in weeds or shallow areas, or partially raised such as to reduce drag while maintaining a rudder effect for stability, or remain lowered in the water.

The trolling motor apparatus 14 preferably includes a wired or wireless remote communication mechanism 26 which communicates between the remote control 28 and the trolling motor head 16 so that the operator 90*a* can control the trolling motor apparatus 14 by actuation of the remote control 28. The trolling motor apparatus 14 preferably includes a power cable 24 to supply electric power, such as may be supplied by a battery (not shown). The trolling motor apparatus 14 preferably includes a trolling motor drive collar 20 which provides for depth adjustment of the trolling motor propeller 22, such as by loosening a fastener 54 and sliding the trolling motor shaft 18 up or down with respect to the drive collar 20, and then tightening the fastener 54 to secure the trolling motor shaft 18 in position. When the trolling motor apparatus 14 is in use, the trolling motor propeller 22 is preferably submerged in the water 2 (which is illustrated by the wavy line indicating the surface of the water 2 in FIG. 1).

During trolling, the view of the trolling motor head 16 by the operator 90*a* who may be sitting near the rear portion 8 of the boat 4 is obstructed by a fisherman 90*b* near the front portion 6 of the boat 4, who may be standing or sitting. Even if there is no fisherman 90*b* near the front portion 6 of the boat 4, a seat or chair 10*b*, or other structure, can obstruct the view of the trolling motor head 16 so that the operator 90*a* cannot easily determine which way the trolling motor head 16 is oriented, interfering with the ability of the operator 90*a* to steer the trolling motor apparatus 14 to propel the boat 4 as desired.

In one embodiment of the present invention, a trolling motor direction guide or visual direction guide 30*a* of the present invention is attached to the trolling motor apparatus 14 and preferably includes a visual indicator 32*a*, an indicator support shaft 40*a*, and shaft mounting apparatus 50*a*. Preferably, the visual indicator 32*a* includes a vane such as a triangular vane 34*a*, although a boat-shaped vane 34*b*, a fish-shaped vane 34*c*, an arrow-shaped vane 34*d*, as illustrated and described herein, or other vane can be used in other embodiments. Preferably, the visual indicator 32*a* includes at least one light or lamp such as lights 36*a* and 36*b* best seen in FIG. 2, which can aid the operator 90*a* in determining the orientation of the visual indicator 32*a* during low-light or poor-visibility situations such as in fog, twilight, or night operation. Preferably, lights 36*a* and 36*b* are located a horizontal distance from each other so that they are distinguishable from each other by observation by the operator 90*a*. Preferably, lights 36*a* and 36*b* are visually different, such as different in size, shape, color, intensity, light pattern, or other manner, so that the operator 90*a* can discern the orientation of the visual indicator 32*a* (see the visual indicator orientation directions 82*a* and 82*b* in FIG. 8) by observation of the lights 36*a* and 36*b* (see FIGS. 2, 4-7, 9, 10). For example, light 36*a* is preferably clear or white light, indicating the front of the visual indicator 32*a*, preferably oriented in the direction of propulsion of the trolling motor apparatus 14 (see the trolling motor propulsion directions 80*a* and 80*b* in FIG. 8), and light 36*b* is preferably red, indicating the rear of the visual indicator 32*a*, preferably oriented opposite the direction of propulsion of the trolling motor apparatus 14. In FIG. 1, the visual indicator 32*a* is preferably pointed in a first visual indicator orientation direction 82*a* which is aligned with a first trolling motor propulsion direction 80*a* which is the direction opposite to the first water propelling direction 78*a* , which is the direction that the propeller 22 moves the water due to action of the propeller 22, as further described herein and shown in FIG. 8. Although the first visual indicator orientation direction 82*a* (in which the visual indicator is pointing) could, in alternate embodiments (not shown) be aligned with the propeller 22 in other ways, it is preferable to align the visual indicator 32*a*-32*e* so that the first visual indicator orientation direction 82*a* is aligned with the propeller 22 as shown in FIG. 1.

The trolling motor direction guide 30*a* preferably includes an indicator support shaft such as a telescoping indicator support shaft 40*a*, although a non-telescoping indicator support shaft 40*b*, a bent indicator support shaft 40*c*, a short telescoping indicator support shaft 40*d*, a short non-telescoping indicator support shaft 40*e*, as illustrated and described herein, or other indicator support shaft can be used in other embodiments. The visual indicator 32*a* is preferably attached or secured to the indicator support shaft upper portion 44 of the indicator support shaft 40*a*. The trolling motor direction guide 30*a* preferably includes a shaft mounting apparatus 50*a* for attachment of the indicator support shaft lower portion 46 to the trolling motor apparatus 14. The shaft mounting apparatus preferably includes a bracket 52, although a fastener 54, a clamp 56*a*, a clamp 56*b*, a folding bracket 58, a motor head clip 60, a motor head socket, as illustrated and described herein, or other shaft mounting apparatus can be used in other embodiments.

When the trolling motor direction guide 30*a* is attached to the trolling motor apparatus 14, the visual indicator 32*a* is located so that it can be seen by the operator 90*a* to determine the trolling motor propulsion direction 80*a*, even when the trolling motor head 16 is not visible to the operator 90*a* past a fisherman 90*b*, chair 10*b*, or other visual obstacle. Preferably, the visual indicator 32*a* is located at a visual indicator elevation distance 38 above the trolling motor head 16. For example, the visual indicator 32*a* may be located from about 30 inches to about 84 inches above the trolling motor head 16. Preferably, the visual indicator 32*a* is located from about 24 inches to about 84 inches above the trolling motor head 16; more preferably, the visual indicator 32*a* is located from about 30 inches to about 72 inches above the trolling motor head 16; still more preferably from about 32 inches to about 60 inches, and yet more preferably from about 36 inches to about 48 inches above the trolling motor head 16. The indicator support shaft length 42 is chosen to obtain the desired location of the visual indicator 32*a* at the visual indicator elevation distance 38 above the trolling motor head 16. For example, in the embodiment illustrated in FIG. 7, in which the indicator support shaft 40*e* is secured to the trolling motor head 16 by a motor head socket 62, a shorter indicator support shaft length 42 is preferable, while in the embodiment illustrated in FIG. 1, in which the indicator support shaft 40*a* is secured to the trolling motor shaft 18 by the bracket 52, a longer indicator support shaft length 42 is preferable. It will be appreciated that the length 42 may be any practical length, preferably at least 30 inches or more, more preferably at least 42 inches or more, even more preferably about 48 inches or more, and still more preferably at least 60 inches or more, and most preferably at least 72 inches or more.

The telescoping indicator support shaft 40*a* illustrated in FIGS. 1-2 preferably telescopes from a compact storage length to a longer deployed length. For example, the telescoping indicator support shaft 40*a* preferably extends to about 42 inches for use, and collapses to about 8 inches for storage (see also FIG. 9 which illustrates the telescoping indicator support shaft 40*a* collapsed for storage).

In the embodiment illustrated in FIGS. 1-3, the shaft mounting apparatus 50*a* includes the bracket 52, which secures the indicator support shaft 40*a* to the trolling motor shaft 18. The indicator support shaft lower portion 46 is preferably removably secured to the bracket 52 using the set screw 64. The bracket 52 is preferably secured to the trolling motor drive collar 20 using the fastener 54, and the drive collar 20 is secured to the trolling motor shaft 18 as well, so that the indicator support shaft 40*a* is thereby secured to the trolling motor apparatus 14. In other embodiments, the trolling motor drive collar 20 includes the bracket 52, and performs both the functions of depth adjustment of the trolling motor propeller 22 and securement of the indicator support shaft lower portion 46. The visual indicator 32*a* preferably includes lights 36*a* and 36*b* as illustrated in FIG. 2. In this example embodiment, the visual indicator 32*a* also includes the triangular vane 34*a* which is preferably oriented so that it points towards the visual indicator orientation direction 82*a*, which is aligned with the trolling motor propulsion direction 80*a*. Preferably, the light 36*a* is a white light oriented at the front or tip of the triangular vane 34*a*, and the light 36*b* is a red light oriented at the rear or wide pack portion of the triangular vane 34*a*, providing a visual indication that the trolling motor propulsion direction 80 is aligned with the direction from the light 36*b* towards the light 36*a*, which is also towards the tip of the triangular vane 34*a*, so that the operator 90*a* can discern the trolling motor propulsion direction 80*a* by observing the visual indicator 32*a*. The attachment of the trolling motor direction guide 30*a* to the trolling motor apparatus 14 is further illustrated in FIGS. 2-3, which show the bracket 52 and the fastener 54 securing the telescoping indicator support shaft 40*a* to the trolling motor shaft 18 (shown in phantom).

Figure 4:
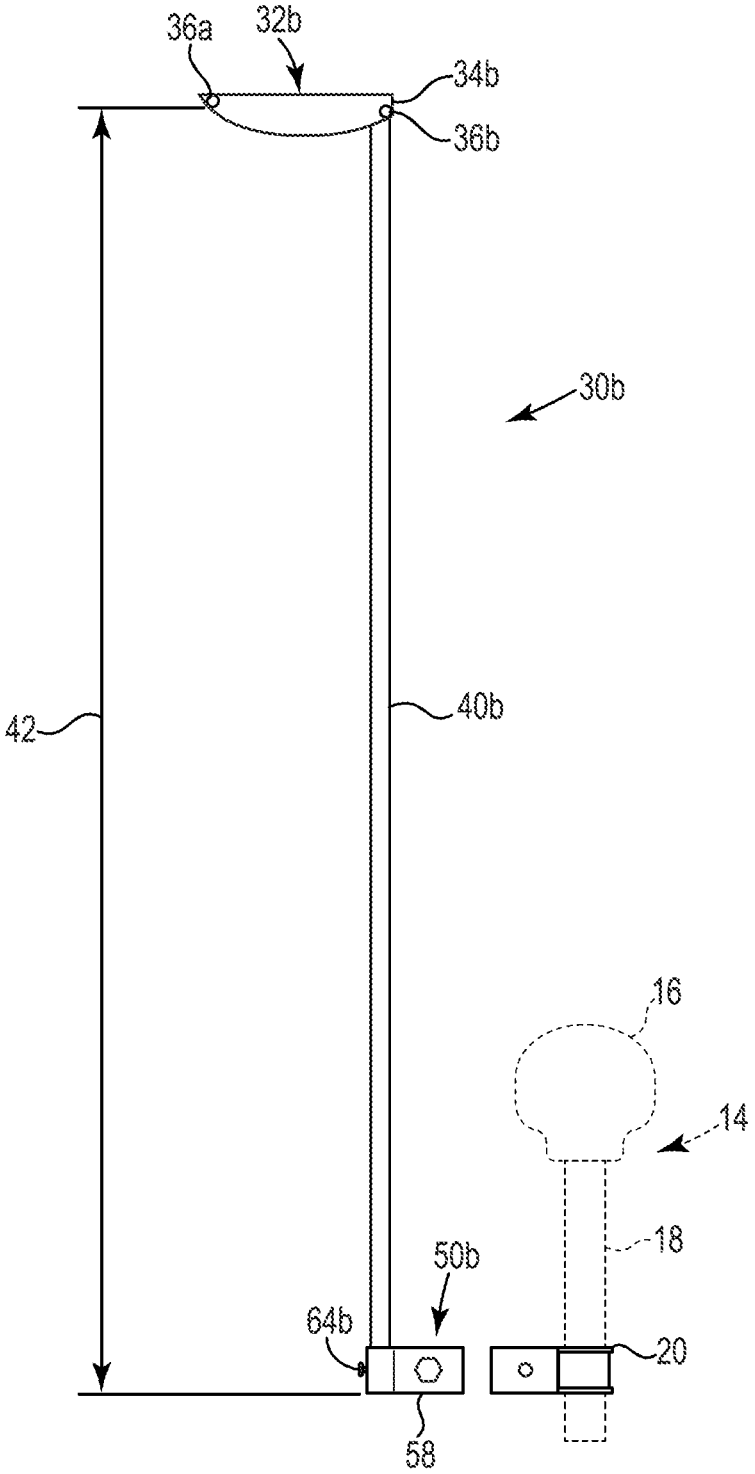
FIG. 4 schematically illustrates an alternative trolling motor direction guide 30*b* similar to that of FIG. 1, but including a non-telescoping support shaft 40*b*, and including an alternate visual indicator 32*b* including a boat-shaped vane and lights, and showing the trolling motor apparatus 14 in phantom as seen in FIG. 2.

In an alternate embodiment of the present invention, the trolling motor direction guide or visual direction guide 30*b* illustrated in FIG. 4 includes the visual indicator 32*b*, which includes the boat-shaped vane 34*b*. This embodiment preferably includes the non-telescoping indicator support shaft 40*b*. In this embodiment, the shaft mounting apparatus 50*b* includes the folding bracket 58, which provides for folding down of the indicator support shaft 40*b* for storage, as further illustrated in FIG. 10.

Figure 5:
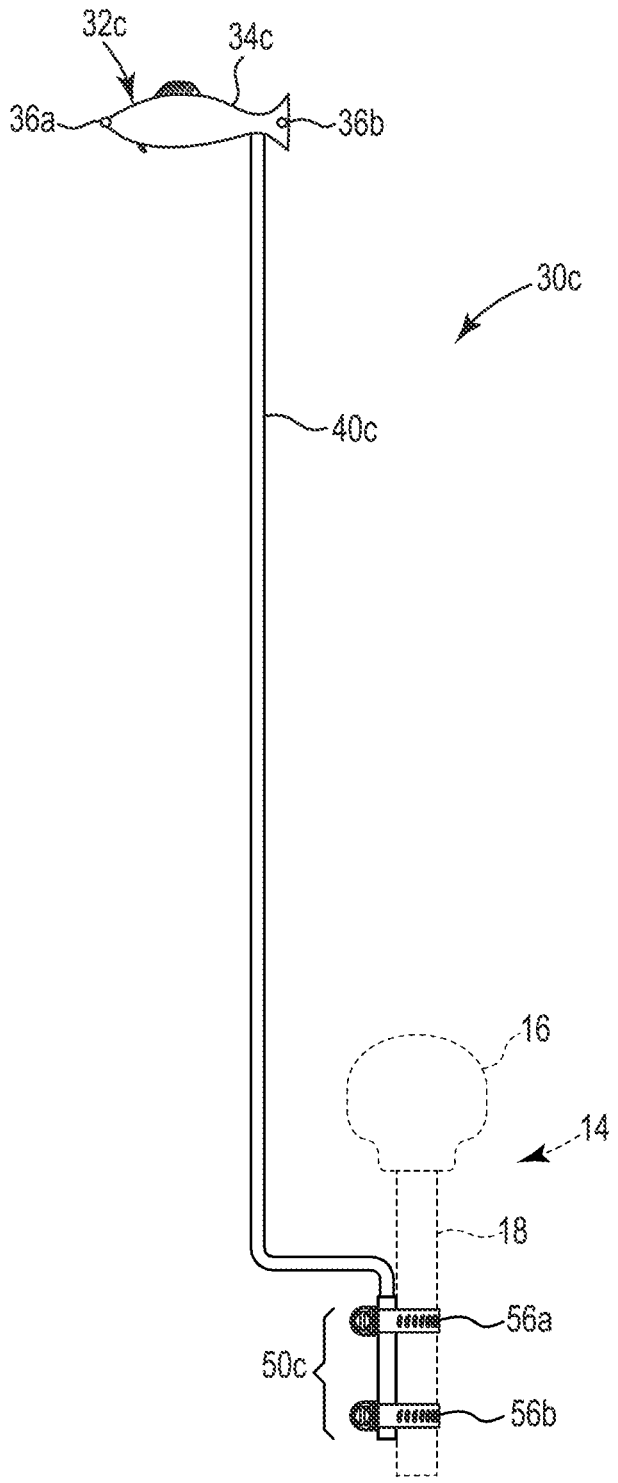
FIG. 5 schematically illustrates a further alternative trolling motor direction guide 30*c* similar to those of FIGS. 1 and 4, but including a bent support shaft 40*c* and a dual clamp shaft mounting apparatus 50*c*, illustrating an alternate visual indicator 32*c* including a fish-shaped vane and lights, and showing the trolling motor apparatus 14 in phantom as seen in FIG. 2.

In an alternate embodiment of the present invention, the trolling motor direction guide or visual direction guide 30*c* illustrated in FIG. 5 includes the visual indicator 32*c*, which includes the fish-shaped vane 34*c*. This embodiment preferably includes the bent indicator support shaft 40*c*. In this embodiment, the shaft mounting apparatus 50*c* includes clamps 56*a* and 56*b*, which secure the indicator support shaft 40*c* to the trolling motor shaft 18. In this embodiment, if it is desired to remove the trolling motor direction guide 30*c* from the trolling motor apparatus 14 such as for storage, the clamps 56*a* and 56*b* are loosened or removed to allow the indicator support shaft 40*c* to be separated from the trolling motor shaft 18.

Figure 6:
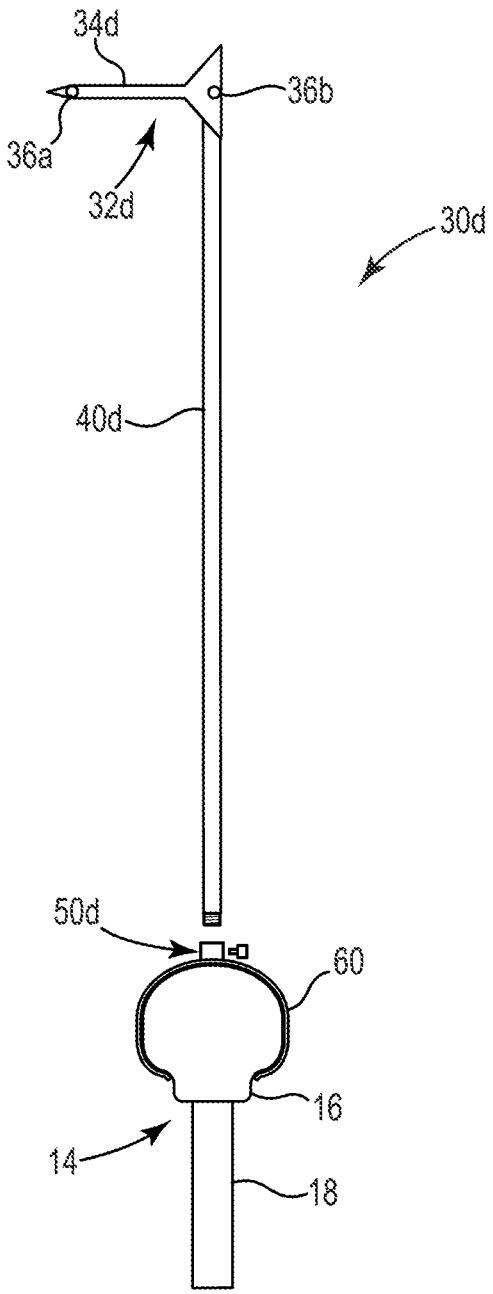
FIG. 6 schematically illustrates a further embodiment of the trolling motor direction guide 30*d* similar to that of FIG. 2, but including an alternative shaft mounting apparatus 50*d* with a motor head clip 60 which attaches to the trolling motor head 16, and illustrating an alternate visual indicator 32*d* including an arrow-shaped vane and lights.

In an alternate embodiment of the present invention, the trolling motor direction guide or visual direction guide 30*d* illustrated in FIG. 6 includes the visual indicator 32*d*, which includes the arrow-shaped vane 34*d*. This embodiment preferably includes the short non-telescoping indicator support shaft 40*d*. In this embodiment, the shaft mounting apparatus 50*d* includes the motor head clip 60 which secures to the trolling motor head 16. For example, fasteners, hook-and-loop fabric, clamps, adhesive, spring tension, mechanical interlock, or other securement mechanisms known in the art can be used to secure the motor head clip 60 to the trolling motor head 16. The indicator support shaft 40*d* is preferably removable from the motor head clip 60 for storage.

Figure 7:
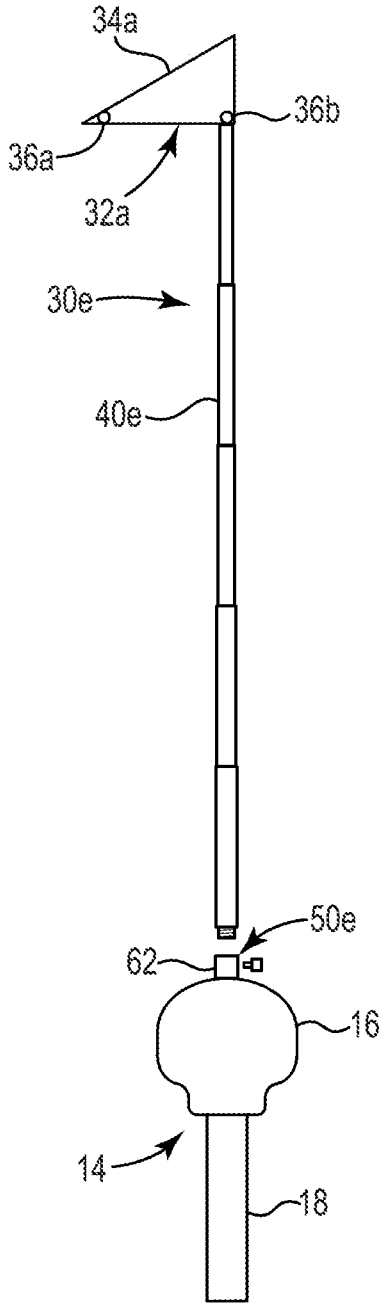
FIG. 7 schematically illustrates a further embodiment of the trolling motor direction guide 30*e* similar to that of FIG. 2, but including an alternative shaft mounting apparatus 50*e* which includes a motor head socket 62 on the trolling motor head 16.

In an alternate embodiment of the present invention, the trolling motor direction guide or visual direction guide 30*e* illustrated in FIG. 7 includes the visual indicator 32*a* as shown in FIG. 2. This embodiment preferably includes the short telescoping indicator support shaft 40*e*. Preferably, in this embodiment, the shaft mounting apparatus 50*e* includes the motor head socket 62. The indicator support shaft 40*e* can be telescopingly collapsed for storage, and is preferably removable from the motor head socket 62 for storage.

Figure 8:
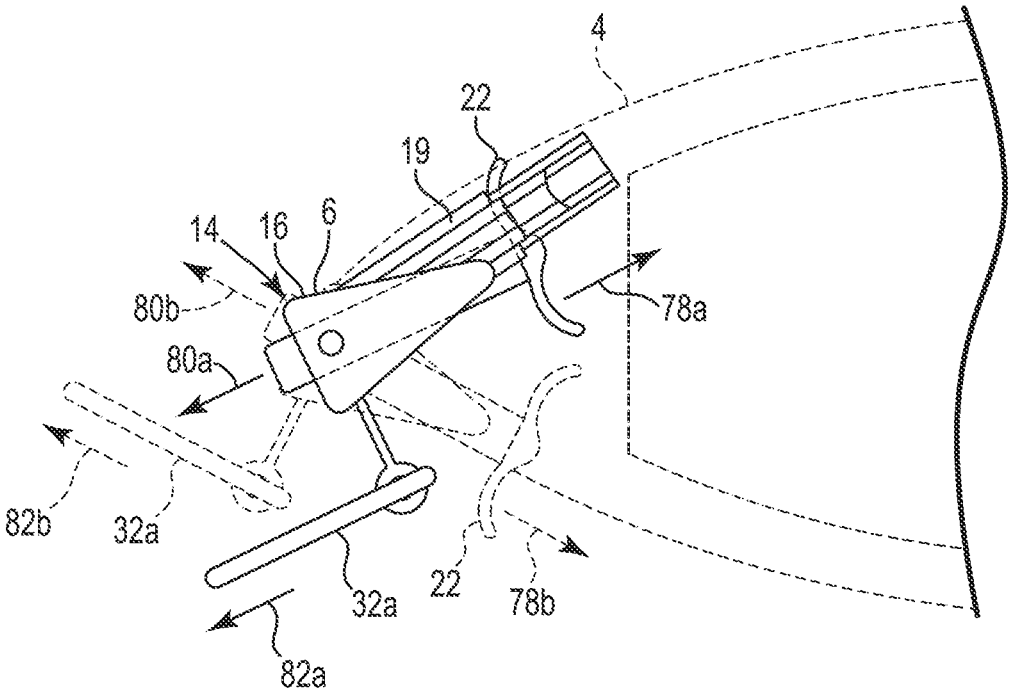
FIG. 8 is a schematic plan view illustrating a portion of the trolling motor direction guide 30*a* of FIG. 2, with an arrow 80*a* indicating the propulsion direction of the trolling motor 14 and an arrow 82*a* indicating the orientation of the visual indicator of the trolling motor direction guide 30*a*, and showing the trolling motor and the trolling motor direction guide in phantom in an alternate position.

The trolling motor apparatus 14 is preferably secured to the boat 4 by the trolling motor boat mount apparatus 19, which allows the trolling motor apparatus 14 to pivot up out of the water 2 for storage on the boat 4. The trolling motor boat mount apparatus 19 is preferably secured at or near the bow 6 of the boat 4, and preferably provides for the trolling motor shaft 18 to be located near the bow 6 of the boat when the trolling motor apparatus 14 is in use; in preferred embodiments, the trolling motor shaft 18 is at or forward of the bow 6 as illustrated in FIG. 1. The trolling motor boat mount apparatus 19 is preferably elongated and can attached to the boat 4 along either side of the bow 6; when the trolling motor apparatus 14 is in position in the water, the trolling motor shaft the trolling motor boat mount apparatus 19 may extend past the bow 6 so that the trolling motor shaft 18 is also located past the bow 6 as shown in FIG. 8.

When the trolling motor propeller 22 is activated, the trolling motor propeller 22 moves the water 4 in the first water propelling direction 78*a*, an causes the trolling motor apparatus 14 to move in the opposite direction, the first trolling motor propulsion direction 80*a*. When the trolling motor direction guide 30*a* is secured to the trolling motor apparatus 14, the orientation of the visual indicator 32*a* defines the first visual indicator orientation direction 82*a* which is preferably aligned with the first trolling motor propulsion direction 80*a* so that the operator 90*a* can determine the trolling motor propulsion direction 80*a* by viewing the visual indicator orientation direction 82*a*, even when the trolling motor head 16 is not visible to the fisherman or operator 90*a*, allowing the operator 90*a* to appropriately steer the trolling motor apparatus 14 by actuation of the remote controller 28. FIG. 8 schematically illustrates one orientation of the trolling motor apparatus 14 and the trolling motor direction guide 30*a*, showing the first trolling motor propulsion direction 80*a* corresponding to the first visual indicator orientation direction 82*a*. Also shown in phantom is another orientation of the trolling motor apparatus 14 and the trolling motor direction guide 30*a*, with a second trolling motor propulsion direction 80*b* corresponding to a second visual indicator orientation direction 82*b*. When operating the trolling motor apparatus 14, the trolling motor propeller 22 spins, applying force to the water 2 adjacent to the trolling motor propeller 22 in a direction generally opposite the trolling motor propulsion direction 80*a*, thereby creating a reaction force generally in the trolling motor propulsion direction 80*a* on the trolling motor propeller 22 and the trolling motor shaft 18, which is secured to the boat 4. The trolling motor apparatus 14 thereby tends to propel the boat 4 in the direction of the trolling motor propulsion direction 80*a* when the trolling motor apparatus 14 is spinning the trolling motor propeller 22. The operator 90*a*, by viewing the visual indicator 32*a*, can determine the visual indicator orientation direction 82*a*, and use the remote controller 28 to steer the trolling motor apparatus 14 to move the boat 4 as desired for effective trolling. The alternate trolling motor direction guide or visual direction guides 30*b*, 30*c*, 30*d*, and 30*e* described herein, provide orientation information to the fisherman or operator 90*a* in a similar manner.

Figure 9:
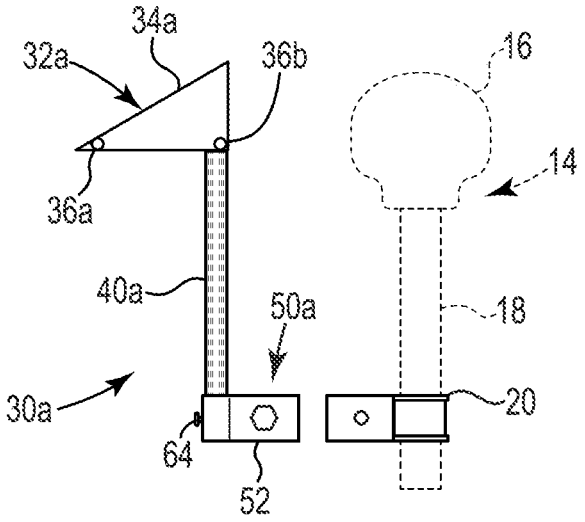
FIG. 9 illustrates the trolling motor direction guide 30*a* as shown in FIG. 2, with the telescoping indicator support shaft 40*a* collapsed compactly for storage.

The telescoping indicator support shaft 40*a* can be telescopingly collapsed for storage as illustrated in FIG. 9. Other telescoping indicator support shafts such as the telescoping indicator support shaft 40*e* illustrated and described herein can be similarly collapsed for storage.

Figure 10:
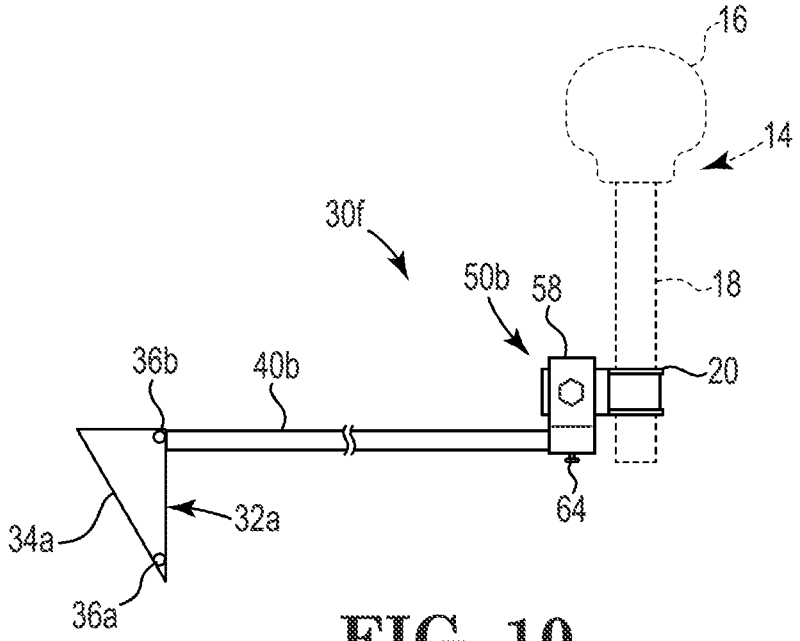
FIG. 10 schematically illustrates a trolling motor direction guide 30*f*, similar to the direction guide 30*b* of FIG. 4, but having a visual indicator 32*a* that is the same as shown in FIG. 2 and also illustrating a folding bracket 50*b* attaching the indicator support shaft 40*b* to the trolling motor shaft 18, which is shown in phantom, and showing the indicator support shaft folded down for storage.

In an alternate embodiment of the present invention, the trolling motor direction guide or visual direction guide 30*f* illustrated in FIG. 10, includes the visual indicator 32*a*, that is the same as shown in FIG. 2, and the non-telescoping indicator support shaft 40*b*, the shaft mounting apparatus 50*b*, and the folding bracket 58, that are the same as shown in FIG. 4. This arrangement provides for folding down of the indicator support shaft 40*b* for storage.

In some embodiments, the respective trolling motor direction guide 30*a*, 30*b*, 30*c*, 30*d*, 30*e*, 30*f* is configured as an accessory which can be secured to the trolling motor apparatus 14 such as by a fisherman 90. In other embodiments, the trolling motor apparatus 14 includes the trolling motor direction guide 30. In other embodiments, the trolling motor apparatus 14 includes elements described herein, such as the motor head socket 62 or the motor head clip 60; other portions of the trolling motor direction guide 30 can then be easily secured to the trolling motor apparatus 14 by a fisherman 90 by utilizing the motor head socket 62 or the motor head clip 60, for example. In alternate embodiments of the present invention (not shown) a controller or remote control can be provided that enables the operator 90*a* to use the remote control to: 1) pivot the trolling motor apparatus 14 to lower the propeller 22 into the water from a secured position above the water 2 on the bow 6 of the boat 4; 2) adjust the depth of the trolling motor propeller 22 by raising or lowering the trolling motor shaft 18; 3) raise the visual indicator 32*a*-32*e* by using electronic controls to extend the telescoping indicator support shaft 40*a* from a collapsed position; and 4) lower the visual indicator 32*a*-32*e* by using electronic controls to collapse the telescoping indicator support shaft 40*a* from an extended position.

In the foregoing description, there are elements which can be exchanged for similar elements, in keeping with the present invention. For example, the triangular vane 34*a*, boat-shaped vane 34*b*, fish-shaped vane 34*c*, or arrow-shaped vane 34*d* can be alternatively utilized with any of the embodiments described herein. The lights 36*a* and 36*b* or other lights 36 as are known in the art can be utilized with any of the embodiments described herein, and may include distinguishing size, shape, color, intensity, light pattern. Similarly, the telescoping indicator support shaft 40*a*, non-telescoping indicator support shaft 40*b*, bent indicator support shaft 40*c*, short telescoping indicator support shaft 40*d*, or short non-telescoping indicator support shaft 40*e* can be alternatively utilized with any of the embodiments described herein. Various combinations of visual indicator 32*a*-32*d*, vane 34*a*-34*d*, light 36*a*-36*b*, and indicator support shaft 40*a*-40*e* may be utilized in embodiments similar to those described herein, in keeping with the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A visual direction guide for attachment to a steerable trolling motor apparatus, the steerable trolling motor apparatus being mountable on a fishing boat, wherein the fishing boat has a bow and a sitting position for an operator within the fishing boat rearward of the bow; and wherein the steerable trolling motor apparatus includes a trolling motor that drives a propeller to create a propulsion direction when the fishing boat is on water and the propeller is immersed in water, the visual direction guide comprising:

an elongated indicator support shaft;

a visual indicator securable to an upper portion of the elongated indicator support shaft; wherein the visual indicator has an elongated form that can be aligned with a direction so that an orientation of the visual indicator will provide an indication of the propulsion direction of the trolling motor to enable the operator to determine the propulsion direction when sitting rearward of the bow and when the operator can only see the visual indicator and its orientation; and a support shaft mounting apparatus securable to a lower portion of the elongated indicator support shaft and securable to a portion of the trolling motor apparatus when the trolling motor apparatus is mounted to the bow of the boat such that, when the visual indicator is secured to the indicator support shaft and the shaft mounting apparatus is secured to the indicator support shaft and to the trolling motor apparatus when the trolling motor apparatus is mounted to the bow of the boat, the visual indicator can be aligned with respect to the propulsion direction of the trolling motor, so that the operator, looking forward toward the bow when seated in the boat rearward from the bow, can visually determine the propulsion direction of the trolling motor by viewing the orientation of the elongated visual indicator when the trolling motor is not visible to the operator.

2. The visual direction guide of claim 1, wherein the visual indicator includes a vane.

3. The visual direction guide of claim 2, wherein the vane is selected from the group consisting of a triangular-shaped vane, a boat-shaped vane, a fish-shaped vane, and an arrow-shaped vane.

4. The visual direction guide of claim 1, wherein the visual indicator includes a light.

5. The visual direction guide of claim 1, wherein the visual indicator includes two lights, each light being distinguishable from the other light and oriented so that the orientation of the visual indicator can be determined by the operator when there is little ambient light.

6. The visual direction guide of claim 1, wherein the elongated support shaft is a telescoping shaft.

7. The visual direction guide of claim 1, wherein when the visual direction guide is in use, the visual indicator is located above the trolling motor apparatus.

8. The visual direction guide of claim 1, further including a folding bracket which allows the indicator support shaft to be folded down for storage.

9. The visual direction guide of claim 1, wherein the trolling motor apparatus includes a trolling motor shaft, and the shaft mounting apparatus secures the indicator support shaft to the trolling motor shaft.

10. The visual direction guide of claim 1, wherein the trolling motor apparatus includes a trolling motor head, the shaft mounting apparatus secures the indicator support shaft to a trolling motor head.

11. A steerable trolling motor apparatus, the steerable trolling motor apparatus being mountable on a fishing boat having a bow, the steerable trolling motor apparatus comprising:

a trolling motor attachable to the bow of the fishing boat, the trolling motor having a propeller driven by a motor, a trolling motor head and a trolling motor shaft;

a remote controller in communication with the trolling motor, capable of turning the trolling motor with respect to the trolling motor shaft; and a visual direction guide including an elongated indicator support shaft, an elongated visual indicator securable to an upper portion of the elongated indicator support shaft, and a shaft mounting apparatus securable to a lower portion of the elongated indicator support shaft and securable to a portion of the trolling motor apparatus;

wherein, when the elongated visual indicator is secured to the indicator support shaft and the shaft mounting apparatus is secured to the indicator support shaft and to the trolling motor, the elongated visual indicator is oriented with respect to the trolling motor so that the operator seated remotely from the bow can determine the direction of propulsion of the trolling motor by viewing the orientation of the elongated visual indicator, even when the trolling motor is not visible to the operator.

12. The steerable trolling motor apparatus of claim 11, wherein the visual indicator includes a vane.

13. The steerable trolling motor apparatus of claim 12, wherein the vane is selected from the group consisting of a triangular-shaped vane, a boat-shaped vane, a fish-shaped vane, and an arrow-shaped vane.

14. The steerable trolling motor apparatus of claim 11, wherein the visual indicator includes a light.

15. The steerable trolling motor apparatus of claim 11, wherein the visual indicator includes two lights, each light being distinguishable from the other light and oriented so that the orientation of the visual indicator can be determined by the operator when there is little ambient light.

16. The steerable trolling motor apparatus of claim 11, wherein the elongated support shaft is a telescoping shaft.

17. The steerable trolling motor apparatus of claim 11, wherein when the visual direction guide is in use, the visual indicator is located above the trolling motor apparatus.

18. The steerable trolling motor apparatus of claim 11, further including a folding bracket which allows the indicator support shaft to be folded down for storage.

19. The steerable trolling motor apparatus of claim 11, wherein the shaft mounting apparatus secures the indicator support shaft to the trolling motor shaft.

20. The steerable trolling motor apparatus of claim 11, wherein the shaft mounting apparatus secures the indicator support shaft to a trolling motor head.

21. The steerable trolling motor apparatus of claim 17, wherein when the visual direction guide is in use, the visual indicator is located between about 30 inches and about 84 inches above the trolling motor head.

22. A method of determining a direction of propulsion of a trolling motor attached to a bow of a boat, the method comprising the steps of:

providing a visual direction guide, the visual direction guide including an elongated indicator support shaft, an elongated visual indicator securable to an upper portion of the elongated indicator support shaft, and a shaft mounting apparatus securable to a lower portion of the elongated indicator support shaft and securable to a portion of the trolling motor;

securing the visual indicator to the indicator support shaft and securing the shaft mounting apparatus to the indicator support shaft and to the trolling motor so that the elongated visual indicator is oriented with respect to the trolling motor apparatus so as to visually indicate the orientation of the direction of propulsion of the trolling motor so as to enable an operator positioned remotely in the fishing boat from the bow to visually determine a direction of propulsion of the trolling motor so as to effectively steer when the operator's view of the trolling motor is visually obstructed.

23. The method of claim 22, wherein the trolling motor is steerable to vary the direction of propulsion of the trolling motor and includes a trolling motor head, and further including the step of:

locating the elongated visual indicator at least about 30 inches above the trolling motor head when the visual indicator is secured to the indicator support shaft and the shaft mounting apparatus is secured to the indicator support shaft and to the trolling motor, so that when an operator of the trolling motor steers the trolling motor to vary the direction of propulsion of the trolling motor, the elongated visual indicator orients to indicate the direction of propulsion of the trolling motor, so that the operator of the trolling motor can visually determine the direction of propulsion of the trolling motor even when the trolling motor is not visible to the operator.

24. A method of steering a fishing boat having a trolling motor apparatus attached to a bow of the fishing boat, the trolling motor apparatus including a remote controller, the method comprising the steps of:

providing a visual direction guide for the trolling motor apparatus, the visual direction guide including an elongated indicator support shaft, an elongated visual indicator securable to an upper portion of the elongated indicator support shaft, and a support shaft mounting apparatus securable to a lower portion of the elongated indicator support shaft and securable to a portion of the trolling motor;

securing the visual direction guide to the trolling motor apparatus;

observing the orientation of the elongated visual indicator to determine the direction of propulsion of the trolling motor apparatus; and steering the fishing boat with the remote controller.

* * * * *